United States Patent [19]

Nishikawa

[11] 4,398,170

[45] Aug. 9, 1983

[54] SWITCH ASSEMBLY FOR VARIABLE RESISTOR

[75] Inventor: Teruo Nishikawa, Miyagi, Japan

[73] Assignee: Alps Electric Co., Ltd., Japan

[21] Appl. No.: 275,124

[22] Filed: Jun. 18, 1981

[30] Foreign Application Priority Data

Jun. 18, 1980 [JP] Japan ..... 55-85354[U]

[51] Int. Cl.[3] ..... H01C 10/50

[52] U.S. Cl. ..... 338/198; 338/172; 338/200

[58] Field of Search ..... 338/172, 198, 200, 201, 338/128–130, 132, 131; 200/275

[56] References Cited

U.S. PATENT DOCUMENTS

| | | | |
|---|---|---|---|
| 1,600,094 | 9/1926 | Carlson | 200/340 |
| 1,614,887 | 1/1926 | Hill | 200/159 A |
| 1,717,057 | 6/1928 | Meuer | 200/159 R |
| 2,844,676 | 7/1958 | Barden et al. | 200/67 |
| 2,932,709 | 4/1960 | Budd et al. | 200/153 |
| 2,947,832 | 9/1960 | Dressel | 200/67 |
| 2,962,571 | 11/1960 | Zanichkowsky | 200/159 |
| 3,196,230 | 7/1965 | Barden et al. | 200/76 |
| 3,236,971 | 2/1966 | Cotsworth | 338/172 X |
| 3,312,925 | 4/1967 | Frantz | 338/198 X |
| 3,808,389 | 4/1974 | Ramsay et al. | 200/159 B |
| 3,840,838 | 10/1974 | Tanaka et al. | 338/198 |
| 3,858,019 | 12/1974 | Muri et al. | 200/159 A |
| 4,053,726 | 10/1977 | Schaad | 200/159 R |

FOREIGN PATENT DOCUMENTS

| | | | |
|---|---|---|---|
| 739205 | 10/1955 | United Kingdom | 338/172 |

*Primary Examiner*—C. L. Albritton

*Attorney, Agent, or Firm*—Guy W. Shoup; Gerard F. Dunne

[57] ABSTRACT

In a multistage variable resistor consisting of rotary variable resistors stacked in a plurality of stages, the rod thereof being slideable in rotary and axial directions; a switch assembly for a multistage variable resistor having the central part of a dome movable contact movable by an actuator which is attached to the posterior end of the rod into contact with a stationary contact.

2 Claims, 8 Drawing Figures

SWITCH ASSEMBLY FOR VARIABLE RESISTOR

BACKGROUND OF THE INVENTION

The present invention relates to a switch assembly for a variable resistor. More particularly, it relates to a switch structure which is suited to be additionally disposed posteriorly to a multistage variable resistor provided with a plurality of rotary variable resistors. More specifically, it provides a switch assembly which is compact, can be controlled easily and reliably and is low in cost.

A switch assembly of the specified type has been installed posteriorly to a multistage variable resistor used for adjusting the sound volume and the tone quality in a car stereo set or the like, and has been employed as a muting switch or the like. The conventional switch assembly, however, does not have the sure feel of positive operation when it is actuated. It has therefore been disadvantageous in that the operating feel is inferior and that the operator feels unsure of operation.

SUMMARY OF THE INVENTION

The present invention has been made in view of the above disadvantage, and has for its object to provide a switch assembly of simple construction affording the appropriate feel for actuation.

According to one aspect of of the present invention, there is provided a switch assembly for a multistage variable resistor having rotary variable resistors stacked in a plurality of stages and a rod slidable in rotary and axial directions; comprising an insulating substrate which is disposed at a stage posterior to said rotary variable resistors, a domed movable contact which has a lead piece extending from an outer periphery of a dome portion thereof, a stationary contact which is separate from said domed movable contact, said lead piece of said movable contact and said stationary contact being mounted on said insulating substrate, and an actuator which is attached to a posterior end part of said rod penetrating through said rotary variable resistors and through which a central part of said dome portion of said domed movable contact can be depressed and brought into contact with said stationary contact.

PREFERRED EMBODIMENT OF THE INVENTION

Hereunder, the details of the present invention will be described with reference to FIGS. 1 to 8.

Figure 1:
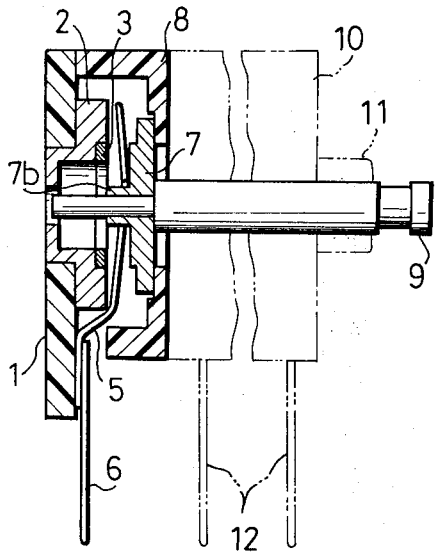
FIG. 1 is a sectional side view of an embodiment of the present invention with its parts simplified.

In FIG. 1, numeral 10 designates a multistage variable resistor which per se has been known and in which any desired number of stages of rotary variable resistors are stacked. A rod 9 is journaled in a bearing 11 in a manner to be slidable in its rotary and axial directions in predetermined amounts. When the rod 9 is rotated, a slider secured to a rotary member not shown slides in contact with a resistance substrate, whereby the resistance value of the variable resistor is varied. The variable resistors have terminals 12.

Figure 2:
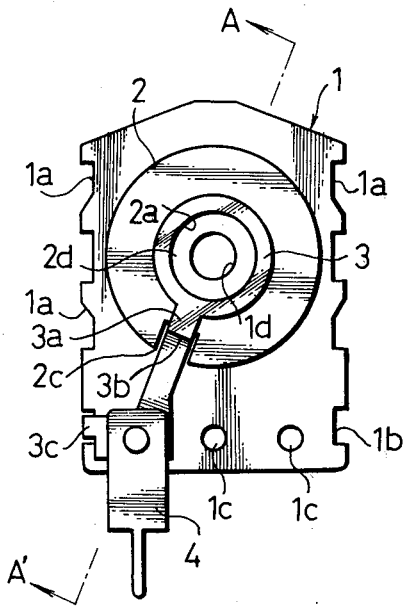
FIG. 2 is a plan view of an insulating substrate in the embodiment under the state under which only a stationary contact is mounted.

Numeral 1 designates an insulating substrate which is mounted at a stage posterior to the multistage variable resistor 10 through a case 8 made of an insulating synthetic resin. As shown in FIG. 2, the insulating substrate 1 is provided with notches 1*a* and 1*b*. An adapter plate (not shown) for putting the variable resistor 10 and the case 8 as well as the insulating substrate 1 into a unitary form is fitted in the notches 1*a*, while the end parts of contacts 3 and 5 to be described later are fastened in engagement with the notches 1*b*. Terminal mounting holes 1*c* are provided in the end part of the insulating substrate 1, and a rod hole 1*d* is provided in the central part of the insulating substrate 1.

Numeral 2 designates an annular insulating spacer which has a hole 2*a* in its central part and which is mounted on the insulating substrate 1. As clearly seen in FIG. 3, the spacer 2 is fixed on the substrate wherein a cylindrical leg 2*b* having at its lower end a flange 2*d* for closing a part of the rod hole 1*d* of the insulating substrate 1 is fitted in the hole 1*d*.

Figure 3:
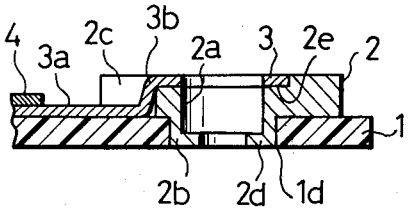
FIG. 3 is a sectional view taken along line A–A' in FIG. 2.

A notch 2*c* serves to lead out the end part of the stationary contact 3. An annular recess 2*e* is formed in the upper inner-peripheral edge of the insulating spacer 2 in a manner to connect with the notch 2*c*. The annular stationary contact 3 is made of a metal sheet and is fitted flush within the recess 2*e* as shown in FIGS. 2 and 3. A lead piece 3*a* of the contact 3 leads out from the insulating spacer 2 via the notch 2*c* and along the surface of the substrate 1. It is held between the substrate 1 and a terminal 4 and is thus fixed to the substrate 1, and its engaging portion 3*c* is fastened in engagement with the sideward notch 1*b* of the substrate 1. Shown at 3*b* is a bent portion of the lead piece 3*a*.

Figure 4:
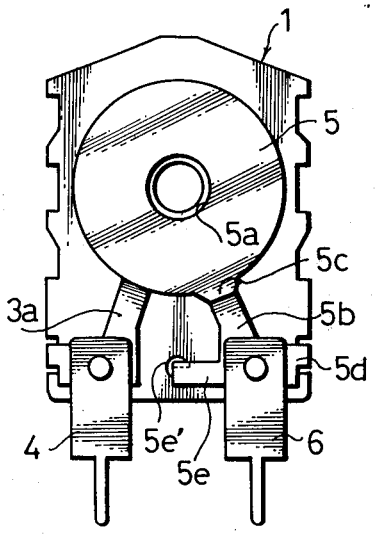
FIG. 4 is a plan view of the insulating substrate under the state under which the stationary contact and a movable contact are mounted.
Figure 5:
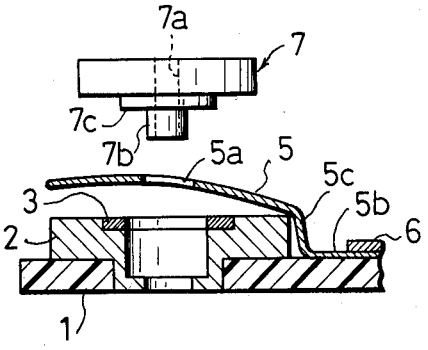
FIG. 5 is a sectional view of important parts of the embodiment illustrated in FIG. 1.

FIG. 4 shows the movable contact 5 mounted on the same insulating substrate 1 shown in FIG. 2. The movable contact 5 is a domed movable contact piece which is made of a single plate formed of resilient metal and has a hole 5*a* in its central part. A lead piece 5*b* of the movable contact 5 extending from the outer periphery of the circular body thereof is led to a terminal 6 via a bent portion 5*c* in a manner similar to the lead piece 3*a* of the stationary contact 3. It is fixed to the substrate 1 by the terminal 6, and has its engaging portion 5*d* fastened in engagement with the sideward notch 1*b* of the substrate 1. In addition, a protuberant piece 5*e* of the lead piece 5*b* extends towards the central terminal-inserting hole 1*c*, and an engaging portion 5*e'* is inserted into the hole 1*c* and fastened in engagement therewith. As best shown in FIG. 5, the movable contact 5 is adapted to have the dome portion above the bent portion 5*c* spaced from the top of the spacer 2 by its resilience.

Figure 7:
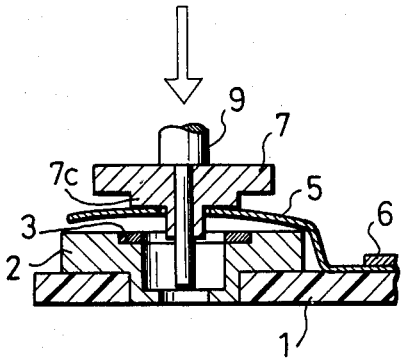

Numeral 7 indicates an actuator of an insulator having a rod hole 7*a* which is formed in its central part, and a flange 7*c* and a cylindrical leg 7*b* which are formed in its lower part, the leg 7*b* being loosely fitted in the hole 5*a* of the movable contact 5 (refer to FIG. 7). As seen from FIG. 1, the rod 9 having penetrated through the variable resistor 10 is inserted through the rod hole 7*a* of the actuator 7, and the cylindrical leg 7*b* is loosely fitted in the hole 5*a* of the movable contact 5. Under the state under which the rod 9 is not depressed, the actuator 7 is resiliently urged against the inner bottom side of the case 8 (rightwards as viewed in FIG. 1) by the movable contact 5. Accordingly, the rod 9 is also urged rightwards in FIG. 1 through the actuator 7.

Figure 6:
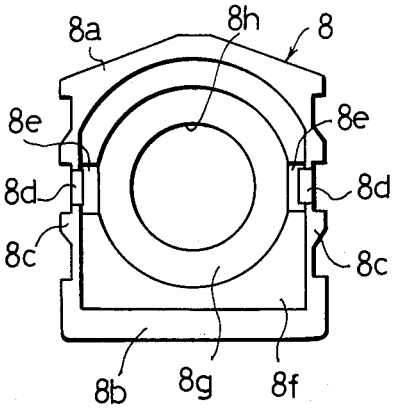
FIG. 6 is a plan view of a case of the embodiment of FIG. 1, and FIGS. 7 and 8 are views for explaining the operation of the embodiment of FIG. 1.

FIG. 6 shows the case 8 which is substantially box-shaped and in which the actuator 7 and the spacer 2 are received. Referring to the figure, frame walls 8*a*, 8*b* and 8*c* of the case extend upwardly at right angles from a bottom portion 8*f*. A pair of engaging pieces 8*d* and 8*d* also extend upwardly and have respective pawls at their upper ends, which serve to fix the substrate 1 to the case. Symbol 8*e* represents an opening, symbol 8*b* a rod inserting hole, and symbol 8*g* a recess which is still lower than the bottom portion 8*f* and in which the foregoing actuator 7 is partly received.

Figure 8:
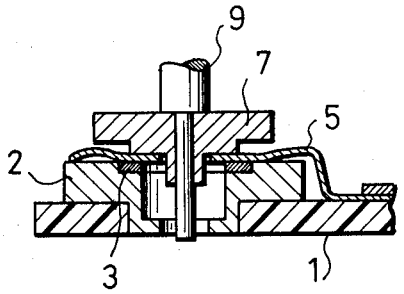

While the operation of the switch assembly will be almost apparent from the construction described above, it will be explained with reference to FIGS. 7 and 8. FIG. 7 shows the non-operating state of the switch. In this case, the domed movable contact 5 does not contact on the stationary contact 3, and the switch is "off". When, under this state, a force in the direction of arrow is applied to the rod 9, the movable contact piece 5 is pressed down by the flange 7*c* of the actuator 7 as illustrated in FIG. 8. A part of the contact 5 is curved inwardly by a snap action to abut on the stationary contact 3, so that the switch turns "on". When, under this state, the operating force on the rod 9 is released, the domed movable contact 5 having been transformed is automatically restored to its original shape by its resilience, and the switch turns "off" again. At the transformation and restoration of the movable contact at the turning on and off of the switch, the appropriate feel is afforded by the snap action of the domed movable contact 5.

Here, in the embodiment, the operating stroke of the movable contact 5 is 0.5 mm. Since, however, the stationary contact 3 has the annular portion recessed in the insulating spacer 2 as stated before and only the central part of the dome portion of the movable contact 5 opposes the stationary contact 3, the abutment and separation between the contacts 3 and 5 are sure, and the reliability is high.

Although, in the embodiment, the switch is turned "on" by pushing the rod 9, it is needless to say that a construction in which the switch is turned "on" by pulling the rod 9 can also be realized by altering the relationship of the mounting positions of the actuator 7 and the insulating substrate 1.

As set forth above, according to the present invention, a movable contact and a stationary contact disposed on an identical substrate are caused to abut and separate, so that a switch assembly can be made compact and thin. Moreover, the movable contact is domed, so that the operation is attended with the appropriate feel to ensure a good operating feeling. The switch assembly is suited to be added to a multistage variable resistor.

I claim:

1. A switch assembly for use with a variable resistor formed by at least one rotary variable resistance device having a common operation rod adapted to be rotated for actuating each said rotary variable resistance device and slid axially within said variable resistor for actuating the switch assembly; comprising a substrate held posteriorly to said variable resistor and carrying a stationary contact; an actuator held to an end portion of said operation rod and spaced from said stationary contact; and a moveable contact formed of a resilient material and having a central portion shaped as a dome extending away from said stationary contact and a lead portion extending from said central portion, said lead portion being connected with said substrate, said central portion engaging said actuator while resiliently urging it continually away from said stationary contact to bias said operation rod continually in its axial outer position and adapted upon inward axial movement of said operation rod to invert the shape of said central portion abruptly to engage said central portion with said stationary contact and to dis-engage the central portion from said stationary contact abruptly upon release of said operation rod.

2. A switch assembly as defined in claim 1, including an insulative spacer holding said stationary contact and adapted to engage the peripheral portions of said central portion of the moveable contact, said spacer having a recess receiving said stationary contact flush therewithin.

* * * * *